US005944505A

United States Patent [19]

Kroecher

[11] Patent Number: 5,944,505

[45] Date of Patent: Aug. 31, 1999

[54] AUTOMATIC CANDLE SNUFFER

[75] Inventor: Andre Kroecher, North Vancouver, Canada

[73] Assignee: Kroecher Designs Inc., North Vancouver, Canada

[21] Appl. No.: 09/172,124

[22] Filed: Oct. 14, 1998

[51] Int. Cl.[6] ..... F23N 5/00

[52] U.S. Cl. ..... 431/35; 431/33; 431/34; 431/149; 431/152

[58] Field of Search ..... 431/34, 33, 35, 431/144, 125, 146, 145, 149, 148, 152; D29/127

[56] References Cited

U.S. PATENT DOCUMENTS

| | | | |
|---|---|---|---|
| 210,336 | 11/1878 | Koontz | 431/34 |
| 314,252 | 2/1885 | Koegel | 431/34 |
| 471,282 | 3/1892 | Van Hise | 431/35 |
| 1,619,998 | 3/1927 | Woodcock | 431/216 |
| 1,940,841 | 12/1933 | Benziger | 431/295 |
| 3,416,871 | 12/1968 | Dragan | 431/125 |
| 3,885,905 | 5/1975 | Giangiulio | 431/34 |

FOREIGN PATENT DOCUMENTS 29608121 7/1996 Germany .

*Primary Examiner*—Larry Jones
*Attorney, Agent, or Firm*—Oyen Wiggs Green & Mutala

[57] ABSTRACT

A candle holder has candles mounted at each end of a pivoting balance arm. A snuffer is located above each candle. When the balance arm is balanced and one of the candles is lit then the lit candle will become lighter as fuel is consumed by combustion at its wick. When this happens the balance arm pivots so that the end of the balance arm bearing the lit candle rises. This continues until the lit candle is raised to a location at which it is extinguished by one of the snuffers. After the candle has been extinguished then the second candle may be lit. The candle holder prevents candles from continuing to burn for extended periods of time. The candle holder is interesting to watch in operation.

21 Claims, 4 Drawing Sheets

AUTOMATIC CANDLE SNUFFER

TECHNICAL FIELD

This invention relates to a candle snuffer which will allow a candle to burn for a given period and then automatically snuff the candle. The invention also relates to a sculpture having parts which are set into motion by the burning of a candle.

BACKGROUND

Candles may be used to provide light or to provide "atmosphere". In most places electric light is more conveniently available than candle light. However, many people find the ever changing appearance of a candle flame to be fascinating. Candles are still widely used as table decorations in homes, restaurants and other places where the atmosphere provided by a candle flame is desired.

Over the ages many types of candle holders have been developed. Some candle holders are primarily ornamental, others are designed to provide specific functions. German patent No. DE 29608121 describes a candlestick which is intended to maintain the elevation of the wick of a wax candle constant as the candle burns. The candlestick mechanism slowly raises the candle in response to the reduction of weight of the candle as it burns.

Candles have open flames. While it is possible to blow a candle flame out, it is not generally desirable to do so. Blowing a candle out can cause shortness of breath. If a person leans to close to a candle in preparation for blowing the candle out the person may be burned. Furthermore, blowing a candle out result in molten wax or other unburnt combustible materials being blown away from the candle. This is at least messy and can be dangerous. Various types of candle snuffers have been developed. The simplest candle snuffers comprise a hollow inverted cup mounted at the end of a rod. The cup can be held over a candle flame until it fills with combustion gases and the atmosphere inside the cup is no longer able to support combustion.

U.S. Pat. No. 3,885,905 discloses a portable candle holder which incorporates an automatic snuffer. The snuffer is disposed so that it will extinguish the flame of a candle in the holder if the holder is tipped over or suddenly jarred.

There is a need for a candle holder which is capable of snuffing a candle flame after a given amount of time. There is a particular need for a candle holder which can effectively and automatically snuff a candle flame and yet is interesting to watch in operation.

SUMMARY OF THE INVENTION

This invention provides a candle holder. The candle holder comprises a base; a balance arm pivotally coupled to the base for pivotal motion about a pivot axis; a first candle on the balance arm on a first side of the pivot axis, a first snuffer mounted above the candle; a counterweight on the balance arm on a second side of the pivot axis. The first candle comprising a wick at which a fuel may be consumed by combustion. When the balance arm is balanced with the first candle at a first position and the first candle is lit, consumption of the fuel at the wick reduces a weight of the first candle. This causes the balance arm to pivot about the pivot axis until the first candle is in a position wherein the first snuffer extinguishes combustion at the wick of the first candle.

Preferably the first candle is of a type which comprises a reservoir for holding a liquid fuel and the wick is mounted to draw liquid fuel from the reservoir. The elevation of the wick does not change in this type of candle as the candle burns. Most preferably the first candle is coupled to the balance arm by a gimbal so that the first candle retains an upright orientation as the balance arm pivots.

The candle holder may comprise a movable weight which is freely movable longitudinally along the balance arm. This accelerates the motion of the first candle as the wick of the first candle approaches the snuffer. The balance arm may be is tubular and the movable weight may then be slidably disposed within a longitudinal bore in the balance arm.

Another aspect of the invention provides a candle holder comprising: a base; a balance arm pivotally coupled to the base for pivotal motion about a pivot axis the balance arm having first and second ends; a first holder on the balance arm for receiving a first candle, the holder located on a first side of the pivot axis; a second holder on the balance arm for receiving a second candle, the second holder located on a second side of the pivot axis; a first snuffer mounted above the first holder; and a second snuffer mounted above the second holder. When the balance arm is balanced with a first candle in the first holder and the first candle at a first position and the first candle is lit, then consumption of fuel at a wick of the first candle reduces a weight of the first candle, and thereby causes the balance arm to pivot about the pivot axis, until the first candle is in a second position wherein the first snuffer extinguishes combustion at the wick of the first candle. At this point the second candle can be lit. The second candle will get lighter as it burns its fuel. Eventually the second candle will rise until its flame is snuffed by the second snuffer. It can be appreciated that when the first candle is extinguished, the candle holder is balanced with the second candle at the bottom of its range of motion. It is not necessary to adjust the balance of the candle holder before lighting the second candle.

BRIEF DESCRIPTION OF THE DRAWINGS

In drawings which illustrate specific embodiments of the invention, but which should not be construed as restricting the spirit or scope of the invention in any way.

DESCRIPTION

Figure 1:
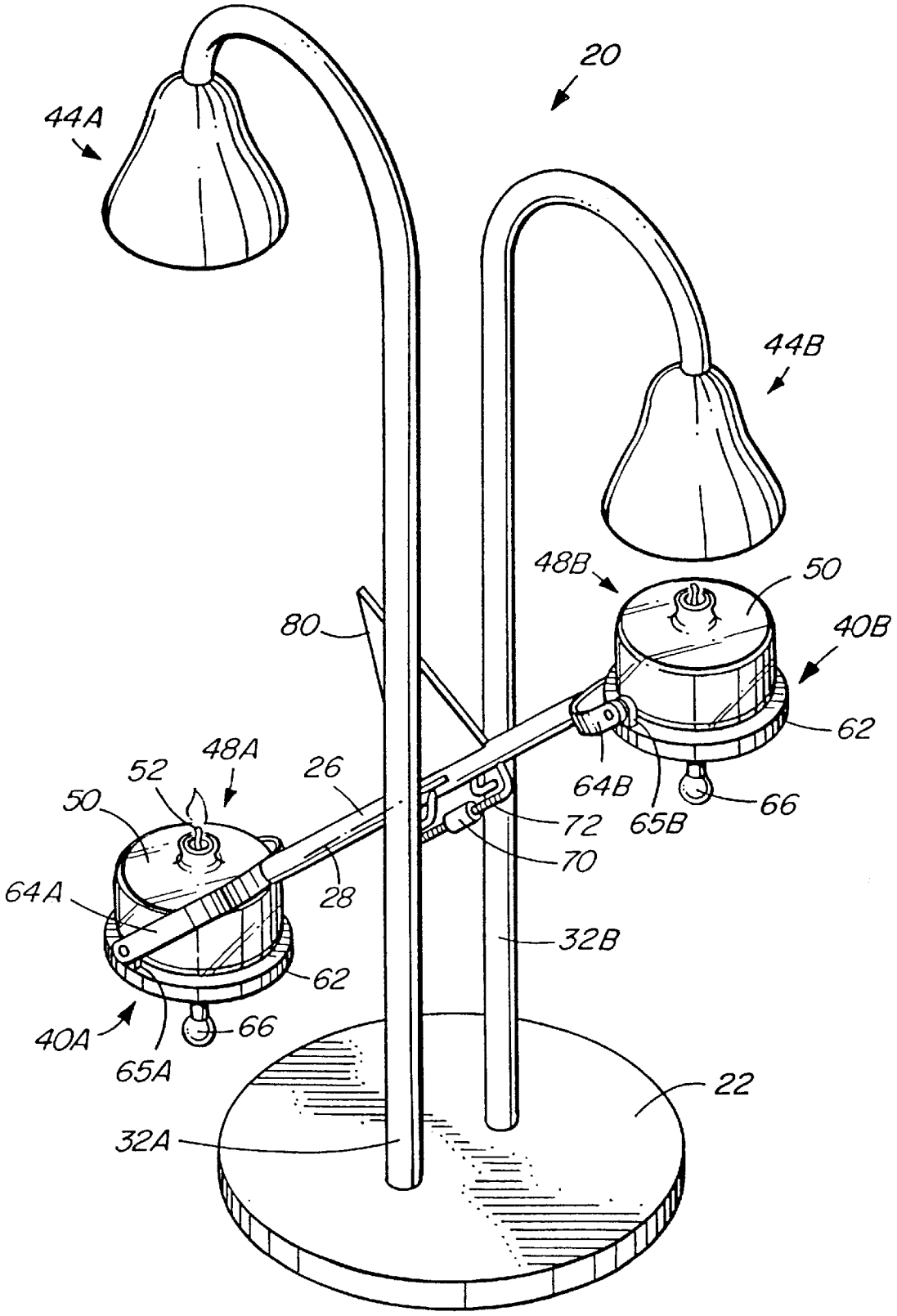
FIG. 1 is a perspective view of a candle holder according to one embodiment of the invention.
Figure 2:
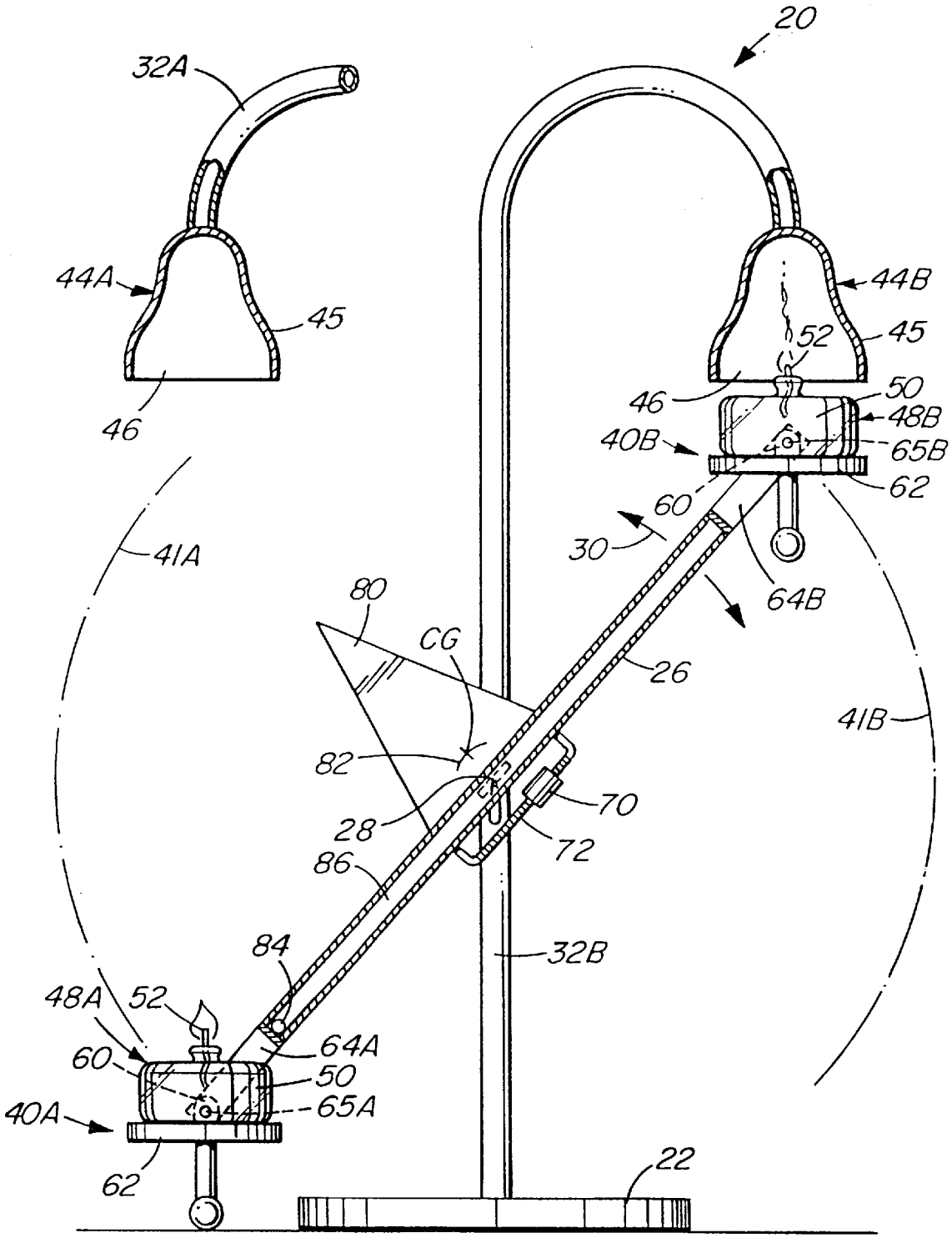
FIG. 2 is a front elevational section through the candle holder of FIG. 1.
Figure 3:
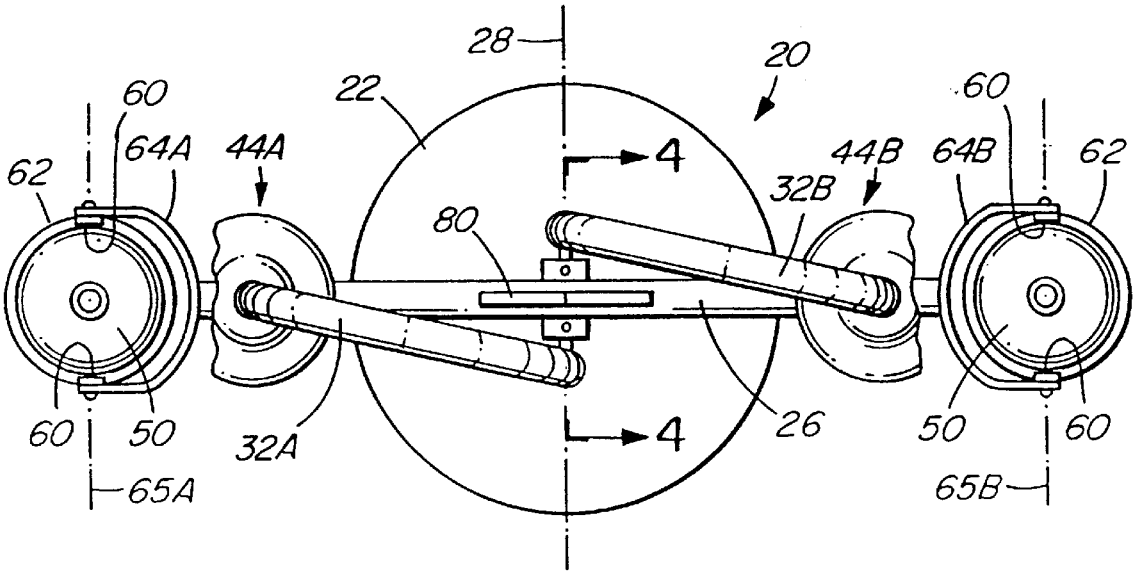
FIG. 3 is a top plan view thereof.
Figure 4:
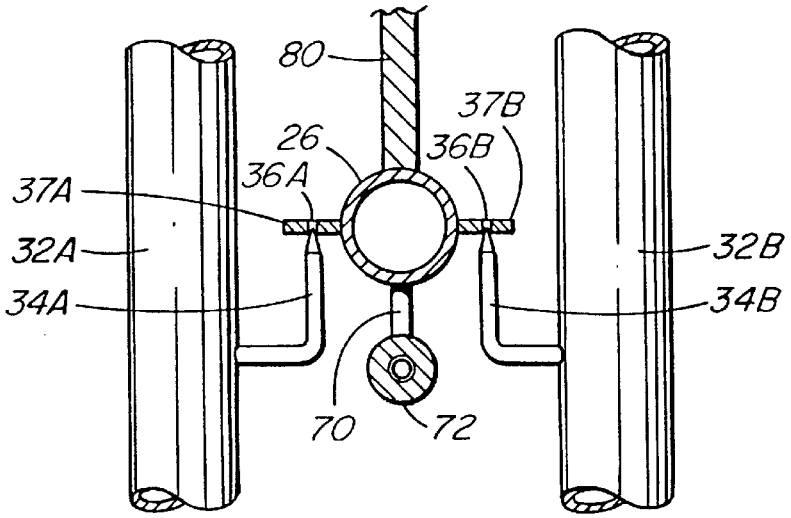
FIG. 4 is a transverse section there through in the plane 3—3.

As shown in FIGS. 1–4, a candle holder 20 according to one embodiment of the invention has a base 22. A balance arm 26 is pivotally mounted to base 22. Balance arm 26 can tilt in either direction about a pivot axis 28 as indicated by arrow 30 (FIG. 2). The pivotal coupling between balance arm 26 and base 22 should allow balance arm 26 to tilt with low friction. Any of many known mechanisms for providing a low friction pivoting connection may be used to couple balance arm 26 and base 22.

In the illustrated embodiment, base 22 includes a pair of upwardly extending rods 32A and 32B. Balance arm 26 passes between rods 32A and 32B and is pivotally supported by a pivotal coupling which includes vertical pins 34A and 34B (best seen in FIG. 4). Pins 34A and 34B have pointed ends which are respectively engaged in conical recesses 36A and 36B in tabs 37A and 37B which project on forward and rearward sides of balance beam 26 respectively. Any other suitable low friction pivotal coupling may be used to pivotally support balance arm 26 on base 22. By way of example only, balance arm 26 may be supported on a horizontal pin which passes transversely through balance arm 26, balance arm 26 may be pivotally supported on knife edges, or the like. All that is required is that balance arm 26 can pivot from side to side without sticking in responses to changes in weight of a candle as the candle burns, as is described below.

Holders 40A and 40B are respectively mounted at first and second ends of balance arm 26. Holders 40A and 40B move along arcuate paths 41A and 41B (FIG. 2) upon tilting of balance arm 26. When holder 40A moves upwardly holder 40B moves downwardly and vice versa. Snuffers 44A and 44B are respectively mounted at upward ends of paths 41A and 41B. In the illustrated embodiment, snuffers 44A and 44B are respectively connected to the upper ends of rods 32A and 32B. Snuffers 44A and 44B may be supported in any other suitable way at the upward ends of paths 41A and 41B. Snuffers 44A and 44B preferably comprise inverted cups 45 having downwardly facing openings 46 capable of receiving a wick of a burning candle and extinguishing combustion at wicks so received.

First and second candles 48A and 48B are respectively supported in holders 40A and 40B. Candles 48A and 48B are preferably each of a type in which the elevation of the wick remains constant as the candle burns. For example, most preferably, candles 48A and 48B each comprise a reservoir 50 containing a liquid fuel, such as kerosene. A wick 52 projects upwardly from reservoir 50. When the candle is lit fuel is drawn up wick 52 by capillary action and consumed by combustion at wick 52.

Most preferably, holders 40A and 40B are constructed so that candles 48A and 48B retain upright orientations as balance arm 26 tilts. This is preferably achieved by suspending candles 48A and 48B from gimbals 60. In the embodiment of FIG. 1, each holder 40A and 40B comprises a platform 62 which is pivotally connected between the arms of U-shaped brackets 64A and 64B which are connected at the first and second ends of balance arm 26. Platforms 62 are each able to pivot about an axis 65A, 65B parallel to axis 28. Weights 66 are affixed to platforms 62. Weights 66 are sufficiently heavy that the centers of gravity of holders 40A and 40B together with candles 48A and 48B are lower than the respective axes 65A and 65B. This ensures that platforms 62 remain horizontal and candles 48A and 48B remain upright at all times.

An adjustment weight 70 is preferably provided on balance arm 26. Adjustment weight 70 may be adjustably moved to a position wherein balance arm 26 is balanced. In the illustrated embodiment adjustment weight 70 is threadedly engaged on a threaded rod 72 which is connected to, and is parallel with balance arm 26. An adjustment weight 70 is useful for setting up candle holder 20 with freshly filled candles 48A and 48B which may not each have exactly the same weights. Adjustment weight 56 needs not be adjusted after candle holder 20 has been put into operation, as described below.

The operation of candle holder 20 will now be described. Candles 48A and 48B are filled with fuel and placed in holders 40A and 40B respectively. Adjustment weight 70 is then adjusted by screwing it along rod 72 until balance arm 26 is just balanced with one of candles 48A and 48B near or at the lower end of its arcuate path 41A or 41B. For example, candle 48A might be the lowermost candle, as shown in FIG. 1.

Candle 48A is then lit. As candle 48A burns it consumes fuel from reservoir 50 at wick 52. This makes candle 48A lighter in weight. As candle 48A continues to consume fuel, balance arm 26 ceases to be balanced. The burning candle 48A begins to rise to keep balance arm 26 in equilibrium. As burning candle 48A rises along path 41A candle 48B falls along path 41B.

Eventually candle 48A rises to the upper end of path 41A at which point its wick 52 enters the cup 45 of snuffer 44A. Snuffer 44A extinguishes the combustion at wick 52 of candle 48A. At this point, balance arm 26 is in balanced equilibrium with candle 48B at the lower end of its path 41B. A user can light candle 48B to repeat the process.

Preferably balance arm 26 has a center of gravity CG which is above pivot axis 28 and moves longitudinally relative to balance arm 26 as balance arm 26 tilts. This may be achieved by providing a weighted member 80 attached to and projecting upwardly from balance arm 26. The high center of gravity causes the motion of candles 48A and 48B to be accelerated as the burning one of the candles approaches its corresponding snuffer. This happens because center of gravity CG moves along a path 82 as balance arm 26 tilts. The force exerted by gravity on balance arm 26 acts through center of gravity CG. As balance arm 26 tilts, CG moves farther and farther past pivot axis 28 toward the lower end of balance arm 26. This helps to accelerate the tilting of balance arm 26.

Optionally a designer may choose to design balance arm 26 and any associated weighted member 80 so that CG is on or below pivot axis 28. This tends to slow down the rate at which a candle 48A or 48B approaches its corresponding snuffer. The position of CG may be altered to fine tune the length of time that each candle 48A or 48B remains burning. The burning time may also be adjusted by setting the wicks of candles 48A and 48B to consume fuel at a faster or slower rate. If wicks 52 are adjusted to provide long flames then fuel is consumed faster and each candle travels more quickly to its corresponding snuffer.

Most preferably one or more movable weights are slidably disposed on or in balance arm 26. For example, as shown in FIG. 2, a ball 84, such as a marble or a ball bearing, is disposed within a bore 86 within balance arm 26. Ball 84 causes further acceleration of the tilting of balance arm 26 as a burning candle approaches its corresponding snuffer. Ball 84 can roll or slide longitudinally in bore 86. When balance arm 26 is initially balanced, ball 84 lies at the lower end of bore 86 closest to the burning candle. Ball 84 remains in this position until balance arm 26 is horizontal. When balance arm 26 continues to tilt past the horizontal then ball 84 rolls along to the opposite end of bore 86 where its weight tends to cause balance arm 26 to tilt faster in the sense required to lift the burning candle to its snuffer.

Figure 5:
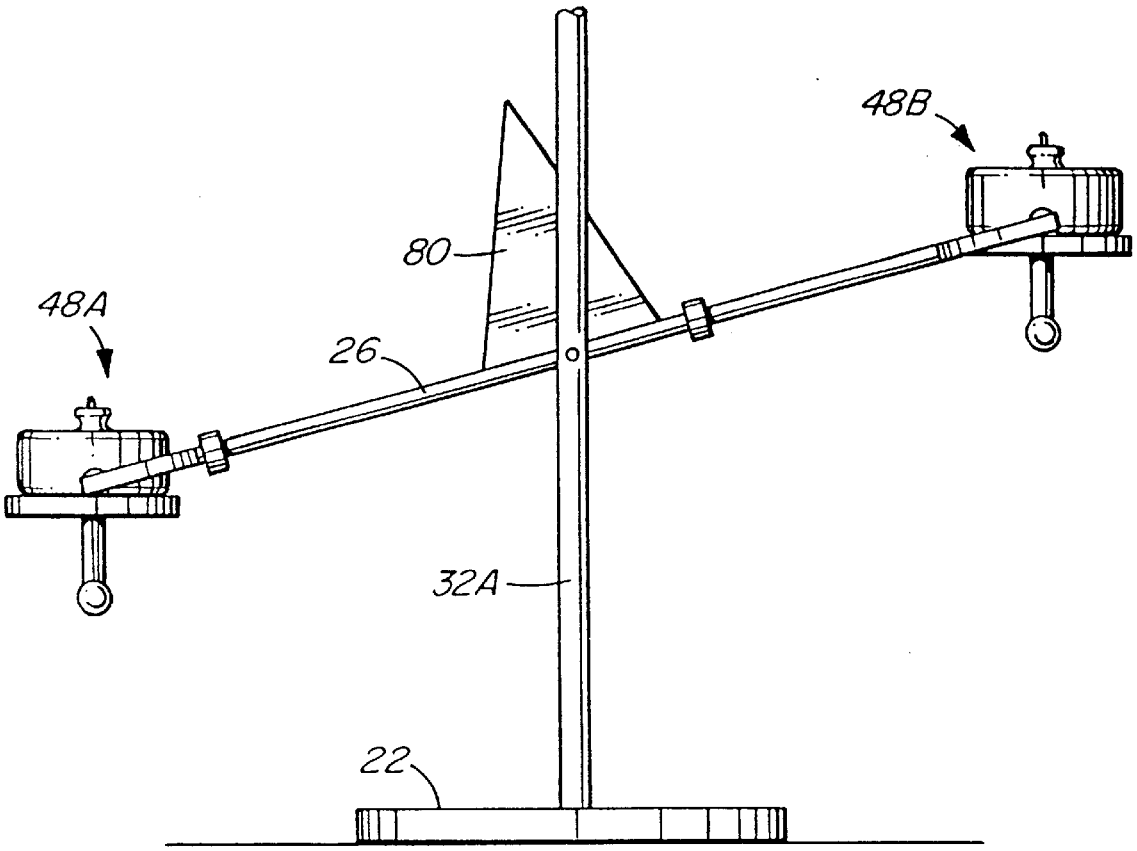
FIG. 5 is a schematic front elevational view of a balance arm according to an alternative embodiment of the invention having weights slidably mounted on its outer surface; and, FIG. 6 is a fragmentary front elevational view of a candle mount according to a further alternative embodiment of the invention.

As an alternative to providing a ball 84 which rides in a bore 86, a ball 84 may roll along a groove or track on balance arm 26. In the further alternative, as shown in FIG. 5, balance arm 26 may extend through apertures in two or more movable weights 85A and 85B which are each slidably disposed on balance arm 26. In some embodiments of the invention it may be preferable to provide a small indentation or the like (not shown) at either end of the groove, track, or balance arm so that the ball or other movable weight will not begin to roll along the track or slide along the balance arm, as the case may be, until the track or balance arm is inclined at an angle to the horizontal which is greater than a threshold angle.

As will be apparent to those skilled in the art in the light of the foregoing disclosure, many alterations and modifications are possible in the practice of this invention without departing from the spirit or scope thereof. The following possible alterations are by way of example only.

Different pivot mechanisms may be used in place of the mechanism described above. Any suitable low friction pivot mechanism may be used. For example, balance arm 26 may be balanced on a sharp edge.

Instead of providing a weighted member 80 to cause the center of gravity CG of balance arm 26 to be above (or below) pivot axis 28 balance arm 26 could be bent to achieve the same effect. In the further alternative the pivoting mechanism could be constructed so that pivot axis 28 is below, on or above center of gravity CG to achieve a desired rate of pivotal motion of arm 26 as a candle burns.

While it is clearly preferable that there be a candle on either end of balance arm 26 it would be possible to practise the invention by replacing one of candles 48A or 48B with a similarly weighted object to serve as a counterweight. If a counterweight is used in place of a candle then preferably the counterweight is movable along balance arm 26 and means are provided to lock the counterweight in a selected place along balance arm 26 so that the counterweight can be positioned where it balances the weight of the single candle on the other end of balance arm 26.

Other adjustment mechanisms may be used instead of the adjustment mechanism described above. While there is preferably some means to initially balance balance arm 26, the adjustment mechanism may be omitted all together. If candles 48A and 48B are of similar weights then the candle holder may be initially balanced by lighting whichever one of the two candles is initially lower. That candle will burn fuel until it has lost enough weight to rise to its corresponding snuffer. At this point the candle holder is balanced and is ready for the other candle to be lit.

Different types of candles may be used. for example, candles 48A and 48B may also be of a type commonly called "tea lights". Tea lights are squat wax candles which are typically supplied inside a thin sheet metal shell. Snuffers 44A and 44B can reliably snuff such candles, even if the level of the candle wick changes, by covering the rim of the sheet metal shell which, of course, does not move as the candle burns. In the further alternative, standard wax candles could be used to practice the invention although a user might occasionally need to adjust the positions of snuffers 44A and 44B or the positions of candles 48A and 48B as the candles become shorter.

Several balance arms 26 equipped with candles, and corresponding sets of snuffers, may be mounted to a single base 22 in any pleasing arrangement which allows the separate balance arms to pivot without interfering with one another.

Figure 6:
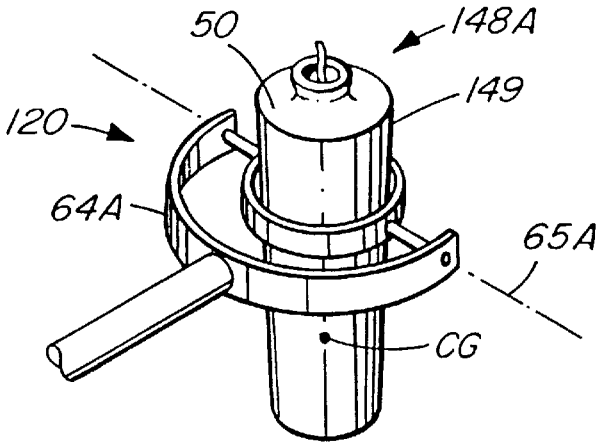

Different holders may be used to support candles 48A and 48B. For example, FIG. 6 shows a candle holder 120 according to an embodiment of the invention wherein a candle 148A comprises a body 149 which incorporates a fuel reservoir 50. Body 149 is pivotally attached to bracket 64A by gimbals which provide a pivot axis 65A. Because the center of gravity CG' of body 149 is below pivot axis 65A, candle 148A tends to retain an upright orientation. This embodiment of the invention avoids the need to provide platforms 62 or counterweights 66.

Different snuffers 44A and 44B may be used in place of inverted cups 45. Any suitable device, mechanical or otherwise, which is capable of reliably extinguishing the flame at the wick 52 of a burning candle may be provided at the upper ends of paths 41A and 41B. Accordingly, the scope of the invention is to be construed in accordance with the substance defined by the following claims.

What is claimed is:

1. A candle holder comprising:

(a) a base;

(b) a balance arm pivotally coupled to the base for pivotal motion about a pivot axis;

(c) a first candle on the balance arm on a first side of the pivot axis, the first candle comprising a wick at which a fuel may be consumed by combustion;

(d) a first snuffer mounted above the candle; and, (e) a counterweight on the balance arm on a second side of the pivot axis;

wherein, when the balance arm is balanced with the first candle at a first position and the first candle is lit, consumption of the fuel at the wick reduces a weight of the first candle, and thereby causes the balance arm to pivot about the pivot axis, until the first candle is in a second position wherein the first snuffer extinguishes combustion at the wick of the first candle.

2. The candle holder of claim 1 wherein the first candle comprises a reservoir for holding a liquid fuel and the wick is mounted to draw liquid fuel from the reservoir.

3. The candle holder of claim 2 wherein the first candle is coupled to the balance arm by a gimbal.

4. The candle holder of claim 3 comprising a movable weight on the balance arm, the movable weight freely movable longitudinally along the balance arm.

5. The candle holder of claim 4 wherein the balance arm is tubular and the movable weight is slidably disposed within a longitudinal bore in the balance arm.

6. The candle holder of claim 4 wherein the movable weight is slidably coupled to the balance arm for longitudinal motion along the balance arm.

7. The candle holder of claim 3 comprising an adjustment weight on the balance arm, the adjustment weight having a position which is adjustable longitudinally along the balance arm.

8. The candle holder of claim 7 comprising a movable weight on the balance arm, the movable weight freely movable longitudinally along the balance arm.

9. The candle holder of claim 8 wherein the balance arm is tubular and the movable weight is slidably disposed within a longitudinal bore in the balance arm.

10. The candle holder of claim 3 wherein a center of gravity of the balance arm is above the pivot axis.

11. The candle holder of claim 1 wherein the counterweight comprises a second candle comprising a wick at which a fuel may be consumed by combustion and a second snuffer mounted above the second candle wherein, wherein, when the balance arm is balanced with the first candle at its second position and the second candle is lit, consumption of the fuel at the wick of the second candle reduces a weight of the second candle, and thereby causes the balance arm to pivot about the pivot axis, until the second candle is in a position wherein the second snuffer extinguishes combustion at the wick of the second candle.

12. The candle holder of claim 11 wherein the first and second candles each comprise a reservoir for holding a liquid fuel and the wicks of the first and second candles are mounted to draw liquid fuel from the reservoirs of the first and second candles respectively.

13. The candle holder of claim 12 wherein the first and second candles are coupled to the balance arm by gimbals.

14. The candle holder of claim 13 comprising a movable weight on the balance arm, the movable weight freely movable longitudinally along the balance arm.

15. The candle holder of claim 14 wherein the balance arm is tubular and the movable weight is slidably disposed within a longitudinal bore in the balance arm.

16. The candle holder of claim 14 wherein the movable weight is slidably coupled to the balance arm for longitudinal motion along the balance arm.

17. The candle holder of claim 13 comprising an adjustment weight on the balance arm, the adjustment weight having a position which is adjustable longitudinally along the balance arm.

18. The candle holder of claim 17 comprising a movable weight on the balance arm, the movable weight freely movable longitudinally along the balance arm.

19. The candle holder of claim 18 wherein the balance arm is tubular and the movable weight is slidably disposed within a longitudinal bore in the balance arm.

20. The candle holder of claim 13 wherein a center of gravity of the balance arm is above the pivot axis.

21. A candle holder comprising:

(a) a base;

(b) a balance arm pivotally coupled to the base for pivotal motion about a pivot axis the balance arm having first and second ends;

(c) a first holder on the balance arm for receiving a first candle, the holder located on a first side of the pivot axis;

(d) a second holder on the balance arm for receiving a second candle, the second holder located on a second side of the pivot axis;

(e) a first snuffer mounted above the first holder;

(f) a second snuffer mounted above the second holder;

wherein, when the balance arm is balanced with a first candle in the first holder and the first candle at a first position and the first candle is lit, then consumption of fuel at a wick of the first candle reduces a weight of the first candle, and thereby causes the balance arm to pivot about the pivot axis, until the first candle is in a second position wherein the first snuffer extinguishes combustion at the wick of the first candle.

* * * * *